US008926205B1

(12) United States Patent
Allen

(10) Patent No.: US 8,926,205 B1
(45) Date of Patent: Jan. 6, 2015

(54) APPARATUS AND METHOD FOR ATTACHING SOAP TO HANDLE

(76) Inventor: Kendall Allen, Sioux City, IA (US)

( * ) Notice: Subject to any disclaimer, the term of this patent is extended or adjusted under 35 U.S.C. 154(b) by 414 days.

(21) Appl. No.: 13/345,054

(22) Filed: Jan. 6, 2012

(51) Int. Cl.
*A47K 5/05* (2006.01)
*A47K 7/03* (2006.01)
*A47K 7/02* (2006.01)

(52) U.S. Cl.
CPC . *A47K 5/05* (2013.01); *A47K 7/028* (2013.01); *A47K 7/03* (2013.01)
USPC ..... 401/88

(58) Field of Classification Search
CPC ..... A47K 5/05; A47K 7/028; A47K 7/03; A47K 5/00; A47K 5/04
USPC ..... 401/88; 15/143.1, 244.1
See application file for complete search history.

(56) References Cited

U.S. PATENT DOCUMENTS 28,422 A * 5/1860 Tusch ..... 401/19
487,094 A * 11/1892 Oefinger ..... 248/684
1,350,585 A * 8/1920 Wirth ..... 401/88
1,667,045 A * 4/1928 Ogden ..... 401/88
1,675,022 A * 6/1928 Creegan ..... 401/88
1,989,022 A * 1/1935 Perrichon ..... 401/19
2,934,852 A * 5/1960 Heberling ..... 248/690
5,011,316 A * 4/1991 Damon ..... 401/6
5,709,490 A * 1/1998 Dyas ..... 401/19
6,397,438 B1 * 6/2002 DeWan ..... 24/306

* cited by examiner

*Primary Examiner* — David Walczak
*Assistant Examiner* — Joshua Wiljanen
(74) *Attorney, Agent, or Firm* — Kenneth L. Green

(57) ABSTRACT

A handle and screw facilitate the applying of soap to hard to reach areas of the body. The handle may be wood, plastic, metal, or the like and may be of various desirable lengths and shapes. The screw is a specialty item with a novel characteristic of having features enabling a bather to easily advance the screw into the handle and a bar of soap wears thinner. The head of the screw is rounded to prevent scratching the user, and the screw either includes engaging features on an underside of the screw head to cause the screw to turn and advance into the handle by turning the soap, or the screw is a barbed screw advanceable by pressing into the handle.

11 Claims, 3 Drawing Sheets

APPARATUS AND METHOD FOR ATTACHING SOAP TO HANDLE

BACKGROUND OF THE INVENTION

The present invention relates to the use of soap while bathing and in particular to soap attached to a handle.

Bathers are often faced with the issue of how to wash difficult to reach areas of their bodies, for example, their upper backs. Most bathers are not able to reach all of the surface of their backs. Various brushes and the like are available to reach these areas, but it remains difficult to deliver soap to these areas.

BRIEF SUMMARY OF THE INVENTION

The present invention addresses the above and other needs by providing a handle and screw which facilitate the applying of soap to hard to reach areas of the body. The handle may be wood, plastic, metal, or the like and may be of various desirable lengths and shapes. The screw is a specialty item with a novel characteristic of having features enabling a bather to easily advance the screw into the handle and a bar of soap wears thinner. The head of the screw is rounded to prevent scratching the user, and the screw either includes engaging features on an underside of the screw head to cause the screw to turn and advance into the handle by turning the soap, or the screw is a barbed screw advanceable by pressing into the handle.

In accordance with one aspect of the invention, there is provided a soap bar fastener having engaging features to penetrate a soap bar to couple rotation of the soap bar with rotation of the threaded fastener. As a result, as the soap bar is worn thinner, the soap bar may be rotated to advance the threaded fastener into the handle, thus removing any need to use a tool or have a sharp edge on the head for engaging a tool. The engaging features may be one or more blades or spikes on a bottom surface of the head of the threaded fastener.

In accordance with another aspect of the invention, there is provided a handle having keyed holes for attaching a washing article. For example, a cord from a shower puff may be inserted through the keyed hole for retaining the shower puff on the handle.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
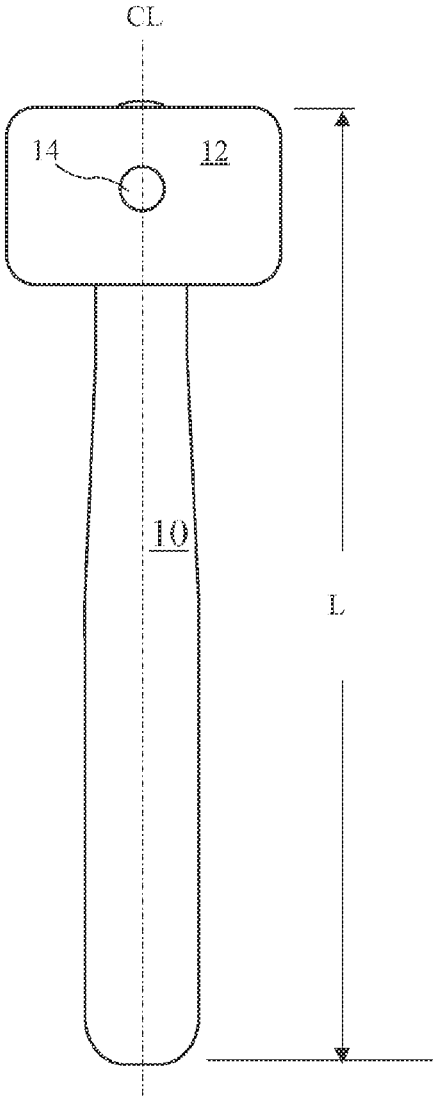
FIG. 1A shows a front view of soap attached to a handle according to the present invention.
Figure 1B:
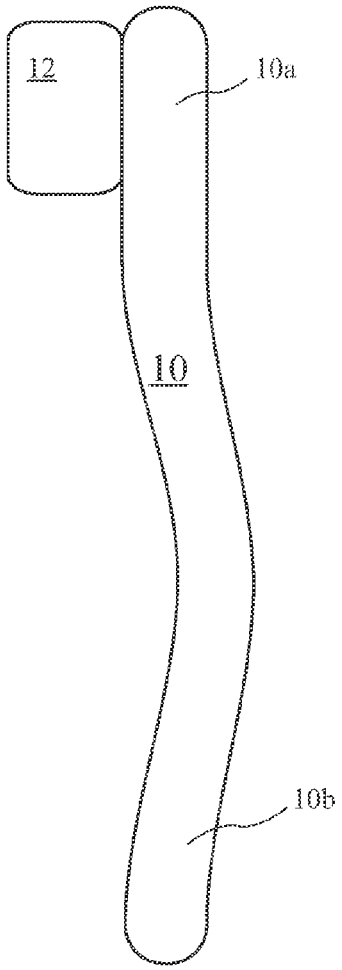
FIG. 1B shows a side view of the soap attached to the handle according to the present invention.
Figure 1C:
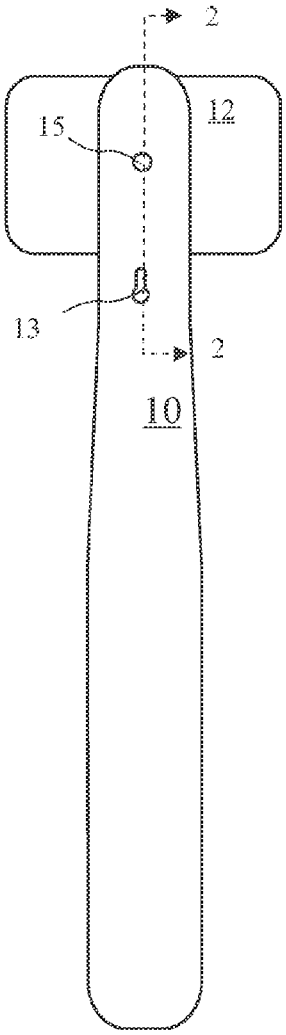
FIG. 1C shows a back view of the soap attached to the handle according to the present invention.
Figure 2:
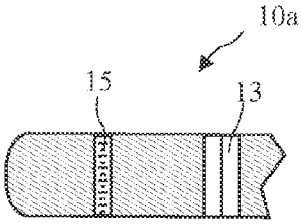
FIG. 2 is a cross-sectional view of the handle according to the present invention taken along line 2-2 of FIG. 1C.

A front view of soap 12 attached to a handle 10 by a fastener 14 according to the present invention is shown in FIG. 1A, a side view of the soap 12 attached to a handle 10 is shown in FIG. 1B, a back view of the soap 12 attached to a handle 10 is shown in FIG. 1C, and a cross-sectional view of the handle 10 taken along line 2-2 of FIG. 1C is shown in FIG. 2. The handle 10 has a centerline CL running generally parallel with a length L of the handle 10 and may have a variety of shapes and lengths corresponding to user's preferences, and any handle having a graspable end 10*b* and a soap attachment end 10*a* is intended to come within the scope of the present invention. The soap may be any bar of soap or container of liquid soap, or material which soap may be applied to, and is preferably any bar soap. A passage 15 passes through the soap attachment end 10*a* for attaching the soap 12, and the passage may be a threaded passage or a barbed passage for cooperation with the fastener 14.

The soap end of the handle 10*a* may further include keyed passage 13. The keyed passage 13 has a larger circular end and a thin slotted end. A cord attached to a washing article, for example, a shower puff, may be inserted through the larger circular end, and drawn into the thin slotted end, to retain washing article on the soap attachment end 10*a* of the handle 10.

Figure 3B:
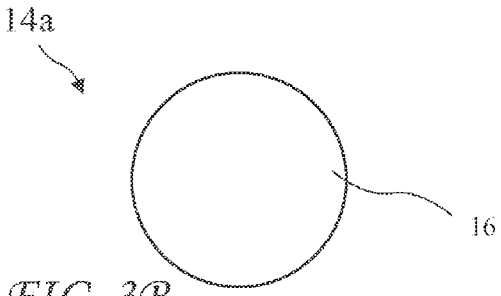
FIG. 3B is a top view of the first embodiment of the fastener for attaching the soap to the handle according to the present invention.
Figure 3A:
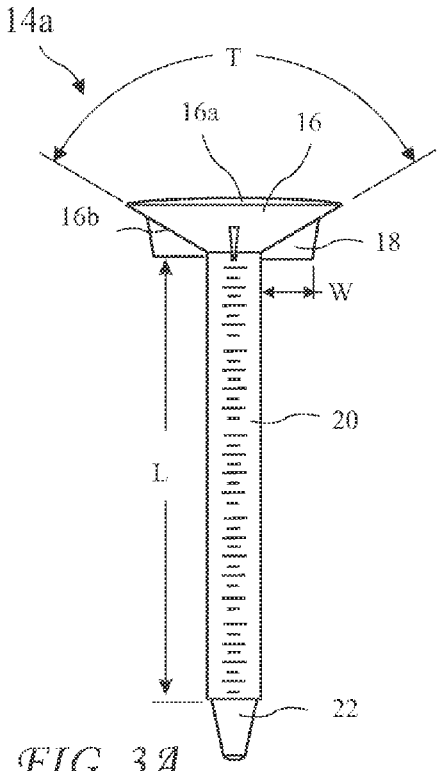
FIG. 3A is a side view of a first embodiment of a fastener for attaching the soap to the handle according to the present invention.
Figure 3C:
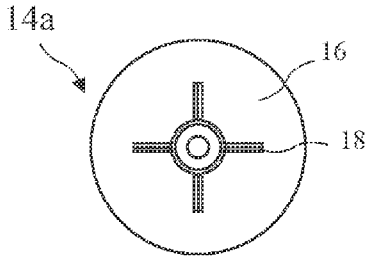
FIG. 3C is a bottom view of the first embodiment of the fastener for attaching the soap to the handle according to the present invention.

A side view of a first embodiment of a fastener 14*a* according to the present invention for attaching the soap 12 to the handle 10 is shown in FIG. 3A, a top view of the fastener 14 is shown in FIG. 3B, and a bottom view of the fastener 14*a* is shown in FIG. 3C. The fastener 14*a* is preferably a plastic or a plastic like material, for example, nylon. The fastener 14*a* is a threaded fastener and preferably has a shaft 20 having a length L of between one and three inches and preferably about 2⅜ inches, a major diameter of preferably between 3/16 and ¼ inches and more preferably about 3/16 inches, and about 20 threads per inch, and cooperates with a threaded passage 15. The head 16 of the fastener 14*a* is about ¾ inches in diameter and has a rounded top surface 16*a* to avoid scratching a user. The bottom surface 16*b* has a taper T of about 120 degrees. The point 22 of the fastener 14*a* tapers down to a rounded end to facilitate pressing the fastener 14*a* into and through a bar of soap, or the fastener 14*a* may be used to attached a liquid soap container to the handle, in which instance, the soap container is provided with a passage for the fastener 14*a*.

An important feature of the fastener 14*a* is one or more engaging features 18 on the bottom surface 16*b* of the head 16. The engaging features 18 may be blades or spikes and penetrate a soap bar to couple rotation of the soap bar with rotation of the threaded fastener 14*a*. As a result, as the soap bar is worn thinner, the soap bar may be rotated to advance the threaded fastener 14*a* into the handle 10, thus removing any need to use a tool or have a sharp edge on the head 16 for engaging a tool. In one embodiment, the engaging features are blade extending a width W from the shaft 20, where the width w is preferably about 3/16 inches.

Figure 4B:
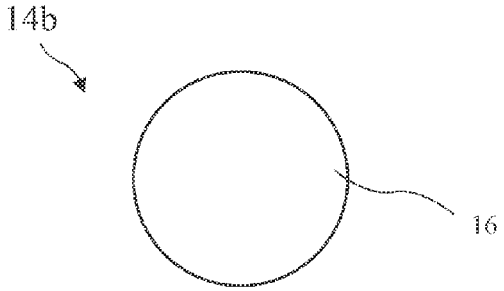
FIG. 4B is a top view of the second embodiment of the fastener for attaching the soap to the handle according to the present invention.
Figure 4A:
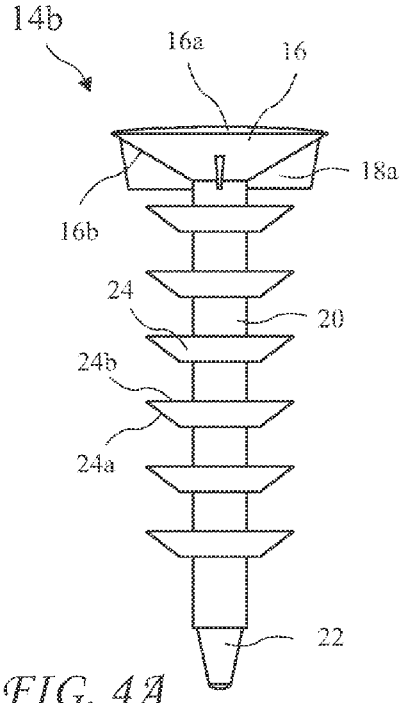
FIG. 4A is a side view of a second embodiment of a fastener for attaching the soap to the handle according to the present invention.
Figure 4C:
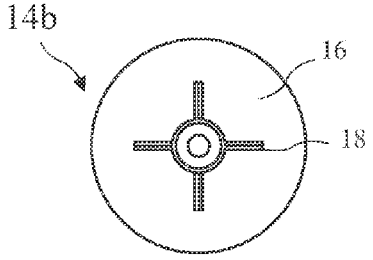
FIG. 4C is a bottom view of the second embodiment of the fastener for attaching the soap to the handle according to the present invention.

A side view of a second embodiment of a fastener 14*b* according to the present invention for attaching the soap 12 to the handle 10 is shown in FIG. 4A, a top view of the fastener 14*b* is shown in FIG. 4B, and a bottom view of the handle 10 is shown in FIG. 4A, a top view of the fastener 14*b* is shown in FIG. 4C. The fastener 14*b* is preferably a plastic or a plastic like material, for example, nylon. The fastener 14*b* includes barbs 24 on the shaft 20, the barbs having a tapered barb face 24*a* facing away from the fastener head 16 and tapering to a smaller diameter towards the fastener point 22, and a flat barb face 24*b* facing towards the fastener head 16, and cooperates with a barbed passage 15 in the handle 10. The fastener 14*b* is advanced as a soap bar wears by merely pressing the fastener 14*b* into the barbed passage 15. When the soap bar is used up, the fastener 14*b* is pulled from the passage 15 for attaching a new soap bar. The blades 18*a* preferably extend outward past the barbs 24. The fastener 14*b* is otherwise similar to the fastener 14*a*.

Figure 5:
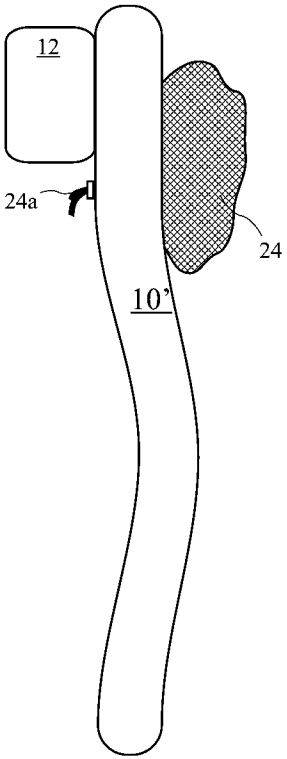
FIG. 5 shows the soap and handle according to the present invention with a shower puff attached to the handle.

The soap 12 and handle 10 according to the present invention may further include a shower puff 24 attached to a handle 10*a* as shown in FIG. 5. A cord 24*a* attached to the puff 24 reaches through the passage 13 (see FIGS. 1C and 2) in the handle 10 to retain the puff 24 on the handle 10.

Figure 6:
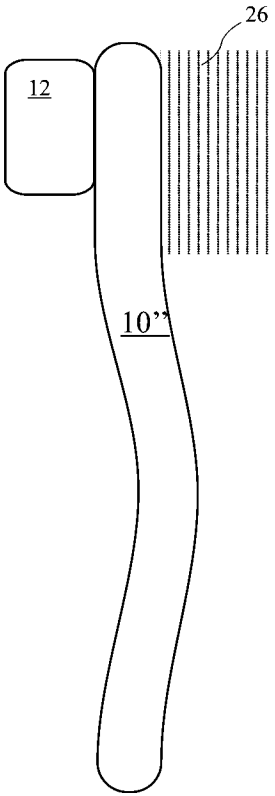
FIG. 6 shows the soap and handle according to the present invention with a brush attached to the handle.

A brush 26 attached to a handle 10" is shown in FIG. 6.

Figure 7:
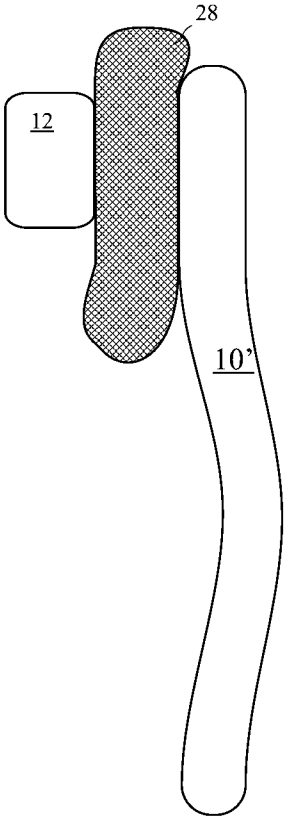
FIG. 7 shows a shower puff or sponge sandwiched between the soap and handle according to the present invention with a brush attached to the handle.

A shower puff or sponge 28 is shown sandwiched between the soap 12 and handle 10' in FIG. 7. The fastener 14*a* engages the soap 12 as described above.

Figure 8:
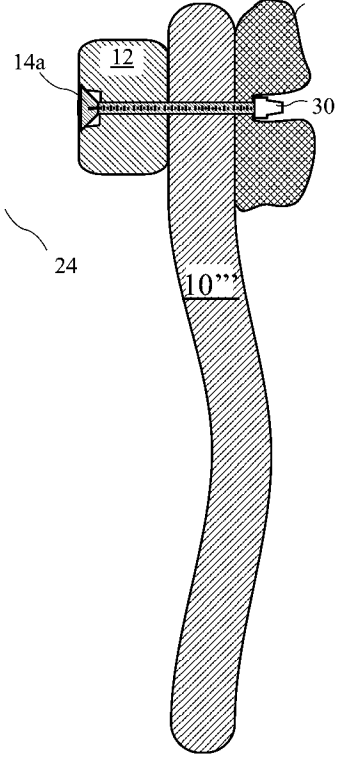
FIG. 8 shows the soap and handle according to the present invention with a shower puff or sponge attached to the handle by a cap nut.

The soap and handle according to the present invention is shown in FIG. 8 with the shower puff or sponge 28 attached to the handle 10 by the fastener 14*a* residing generally perpendicular to the CL (see FIG. 1A) of the handle and a cap nut 30.

While the invention herein disclosed has been described by means of specific embodiments and applications thereof, numerous modifications and variations could be made thereto by those skilled in the art without departing from the scope of the invention set forth in the claims.

I claim:

1. A soap fastener and handle comprising:

a handle having a grasping end and a soap attachment end and a centerline (CL) running generally parallel with a length (L) of the handle;

a fastener passage perpendicular to the centerline (CL) of the handle and through the soap attachment end of the handle for attaching soap; a soap bar attached to the soap attachment end; and a fastener configured to pass through the fastener passage and reside perpendicular to the centerline (CL) of the handle, to retain soap on the handle.

2. The soap fastener and handle of claim 1, wherein the fastener has a head about ¾ inches in diameter.

3. The soap fastener and handle of claim 2, wherein the fastener is a threaded fastener.

4. The soap fastener and handle of claim 3, wherein engaging features reside on a bottom face of the fastener head.

5. The soap fastener and handle of claim 4, wherein engaging features are at least one blade.

6. The soap fastener and handle of claim 5, wherein engaging features are four blades.

7. The soap fastener and handle of claim 2, wherein the fastener includes a shaft extending from the head and through the soap, and spaced apart barbs on the shaft, the barbs having a tapered barb face facing away from the fastener head and tapering to a smaller diameter towards a fastener point, and a flat barb face facing towards from the fastener head, the barbs cooperating with a barbed passage in the handle.

8. The soap fastener and handle of claim 1, wherein the handle includes at least one accessory passage through the handle proximal to the fastener passage for attaching bathing accessories to the handle.

9. The soap fastener and handle of claim 1, wherein the handle includes brush bristles on a face of the soap attachment end.

10. A soap fastener and handle comprising:

a handle having a grasping end and a soap attachment end;

a threaded passage through the soap attachment end for attaching soap; and a soap bar attached to the soap attachment end; a threaded fastener configured to cooperate with the passage to retain the soap bar on the handle, the threaded fastener comprising:

a fastener head about ¾ inches in diameter; and engaging features residing on a bottom face of the fastener head configured to engage the soap bar and to couple turning the soap bar with turning the threaded fastener and advancing the threaded fastener into the handle.

11. A soap fastener and handle comprising:

a handle having a grasping end and a soap attachment end and a centerline (CL) running generally parallel with a length (L) of the handle;

a threaded passage perpendicular to the centerline (CL) of the handle and through the soap attachment end of the handle for attaching soap; and a soap bar attached to the soap attachment end; a threaded fastener configured to pass through the passage and reside perpendicular to the centerline (CL) of the handle and cantilevered from the handle to retain the soap bar on the handle, the threaded fastener comprising:

a threaded shaft engaging the threaded passage;

a fastener head having a bottom face in intimate contact with the soap and holding the soap against the handle and not in contact with the handle or with any support fixedly attached to the handle; and engaging features residing on the bottom face of the fastener head configured to engage the soap bar and to couple turning the soap bar with turning the threaded fastener and advancing the threaded fastener into the handle.

* * * * *